US009226585B1

(12) United States Patent
Bright

(10) Patent No.: US 9,226,585 B1
(45) Date of Patent: Jan. 5, 2016

(54) INFANT RAILS FOR A COUCH

(71) Applicant: Michele S. Bright, Huntsville, AL (US)

(72) Inventor: Michele S. Bright, Huntsville, AL (US)

( * ) Notice: Subject to any disclaimer, the term of this patent is extended or adjusted under 35 U.S.C. 154(b) by 0 days.

(21) Appl. No.: 14/203,796

(22) Filed: Mar. 11, 2014

(51) Int. Cl.
*A47C 7/42* (2006.01)
*A47C 20/02* (2006.01)
*A47C 7/62* (2006.01)

(52) U.S. Cl.
CPC ..... *A47C 7/62* (2013.01)

(58) Field of Classification Search
CPC ..... A47C 7/62
USPC ..... 297/230.1, 230.11, 230.12, 230.13, 297/230.14, 352, 452.63; 5/658, 53.1, 53.2, 5/53.3, 633, 634
See application file for complete search history.

(56) References Cited

U.S. PATENT DOCUMENTS

| | | | | | |
|---|---|---|---|---|---|
| 111,365 | A | | 1/1871 | McArthur | |
| 542,759 | A | | 7/1895 | Froehlich | |
| 2,001,252 | A | * | 5/1935 | Johnson | 297/350 |
| 2,429,795 | A | * | 10/1947 | Blanchard et al. | 297/118 |
| 2,457,978 | A | * | 1/1949 | Curran | 297/350 |
| 2,544,428 | A | | 3/1951 | Judy | |
| 2,611,909 | A | * | 9/1952 | Dillon et al. | 5/426 |
| 2,663,880 | A | * | 12/1953 | Meeks | 5/634 |
| D174,004 | S | | 2/1955 | Schiffman | |
| 2,763,014 | A | * | 9/1956 | Luger | 5/426 |
| 2,859,454 | A | * | 11/1958 | Beckwell | 5/426 |
| 2,904,799 | A | * | 9/1959 | Berlin | 5/426 |
| 2,991,487 | A | * | 7/1961 | Beckwell | 5/426 |
| 3,402,409 | A | * | 9/1968 | Kain | 5/426 |
| 4,104,751 | A | * | 8/1978 | Churchman | 5/503.1 |
| 4,214,327 | A | * | 7/1980 | Smith | 5/651 |
| 4,233,699 | A | * | 11/1980 | Amato | 5/426 |
| 4,483,028 | A | * | 11/1984 | Payne | 5/426 |
| 4,515,361 | A | * | 5/1985 | Melillo | A63B 23/0211 5/658 X |
| 4,833,743 | A | * | 5/1989 | Howell et al. | 5/426 |
| D316,339 | S | | 4/1991 | Taylor | |
| 5,100,203 | A | * | 3/1992 | Novak | 297/382 |
| 5,233,710 | A | | 8/1993 | Bernard | |
| 5,379,469 | A | | 1/1995 | Millis et al. | |
| 5,437,067 | A | * | 8/1995 | Bernstein et al. | 5/426 |
| 5,577,277 | A | * | 11/1996 | Sundberg et al. | 5/426 |
| 5,604,941 | A | | 2/1997 | Roman | |
| 5,640,726 | A | * | 6/1997 | Fichner-Rathus | 5/426 |
| 5,642,541 | A | * | 7/1997 | Corbin | A47B 23/02 5/658 X |
| 5,715,551 | A | | 2/1998 | Proano et al. | |
| 6,134,731 | A | * | 10/2000 | Thom et al. | 5/662 |
| 6,164,726 | A | * | 12/2000 | Reeves et al. | 297/352 X |
| 6,374,440 | B1 | * | 4/2002 | Thim, Jr. | 5/633 |
| 6,453,490 | B1 | * | 9/2002 | Cardinale | 5/426 |
| 6,594,834 | B2 | | 7/2003 | Fenty et al. | |
| 6,952,847 | B1 | * | 10/2005 | Cleary | 5/430 |
| 7,237,285 | B2 | * | 7/2007 | Brewin et al. | 5/426 |
| 7,758,119 | B1 | * | 7/2010 | Baterdouk | 297/230.1 |
| 8,152,236 | B1 | * | 4/2012 | Romero | 297/230.11 |
| 8,262,157 | B2 | * | 9/2012 | Novak | 297/230.1 X |
| 8,296,882 | B1 | * | 10/2012 | Esposito | 5/426 |
| 8,365,324 | B2 | * | 2/2013 | Flannery | 5/430 |

(Continued)

*Primary Examiner* — Rodney B White

(57) ABSTRACT

Infant rails for a couch is constructed of a base member attached via a hinge to a vertical member. The base member is configured to be supported between a seat cushion and a seat base of a sofa or couch. The vertical member is oriented vertically to form a barrier, which prevents a baby from falling off of said sofa or couch. The vertical member and the base member are each constructed of a plurality of slats that are parallel with one another, and which are equally spaced apart from one another.

1 Claim, 4 Drawing Sheets

(56) References Cited

U.S. PATENT DOCUMENTS 8,459,738 B2 * 6/2013 Downey ..... 297/230.1
8,627,523 B2 * 1/2014 Kaiser ..... 5/658
2003/0024047 A1 * 2/2003 Wu ..... 5/430
2007/0035169 A1 * 2/2007 Sawyer ..... 297/382

* cited by examiner

INFANT RAILS FOR A COUCH

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of a safety rail that is configured to be used with a couch or sofa, more specifically, a safety rail system that prevents a baby from rolling off of said couch or sofa.

SUMMARY OF THE INVENTION

An embodiment of the disclosure meets the needs presented above by generally comprising a base member attached via a hinge to a vertical member. The base member is configured to be supported between a seat cushion and a seat base of a sofa or couch. The vertical member is oriented vertically to form a barrier, which prevents a baby from falling off of said sofa or couch. The vertical member as well as the base member are each constructed of a plurality of slats that are parallel with one another, and which are equally spaced apart from one another. The hinge connects the vertical member to the base member, and enables the vertical member to rotate from a parallel orientation (storage position) with the base member to a perpendicular orientation (in-use position).

BRIEF DESCRIPTION OF THE DRAWINGS

The disclosure will be better understood and objects other than those set forth above will become apparent when consideration is given to the following detailed description thereof. Such description makes reference to the annexed drawings wherein.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
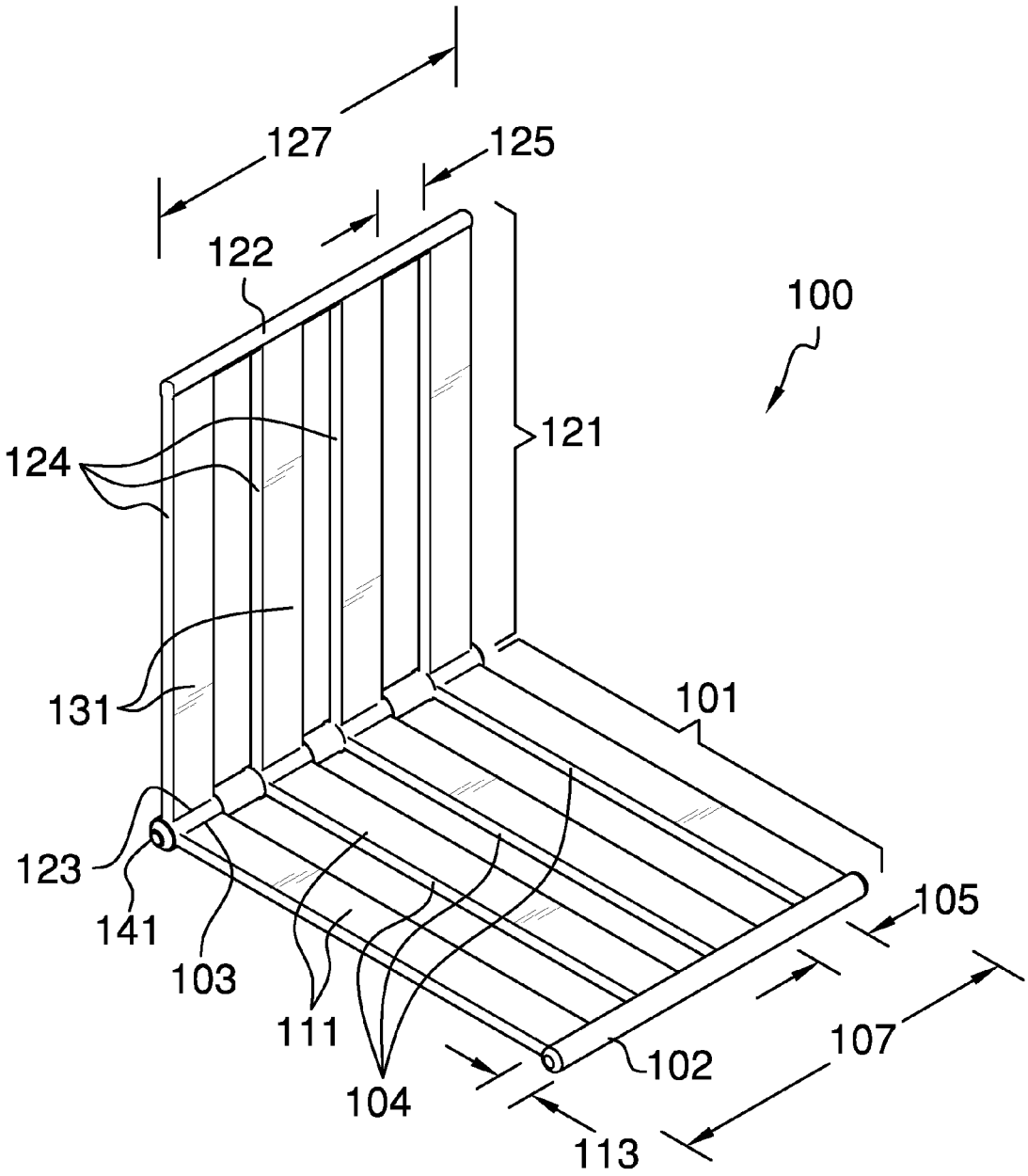
FIG. 1 is a top perspective view of an embodiment of the disclosure by itself.
Figure 2:
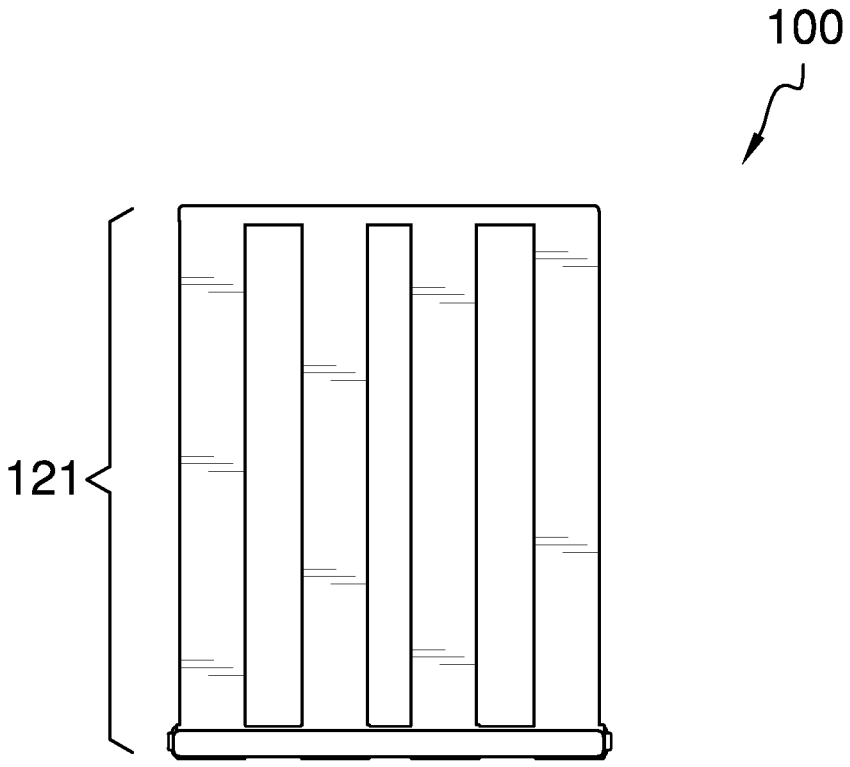
FIG. 2 is a front view of an embodiment of the disclosure by itself.
Figure 3:
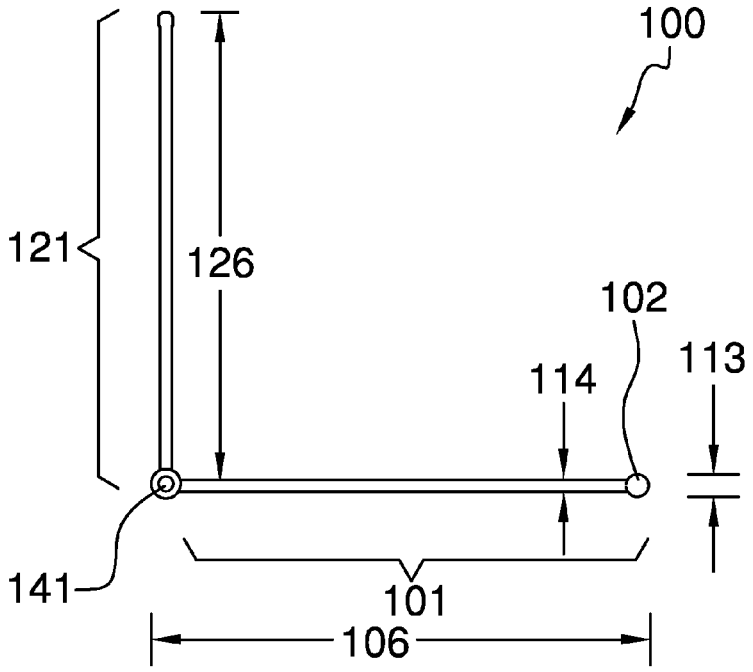
FIG. 3 is a side view of an embodiment of the disclosure by itself.
Figure 4:
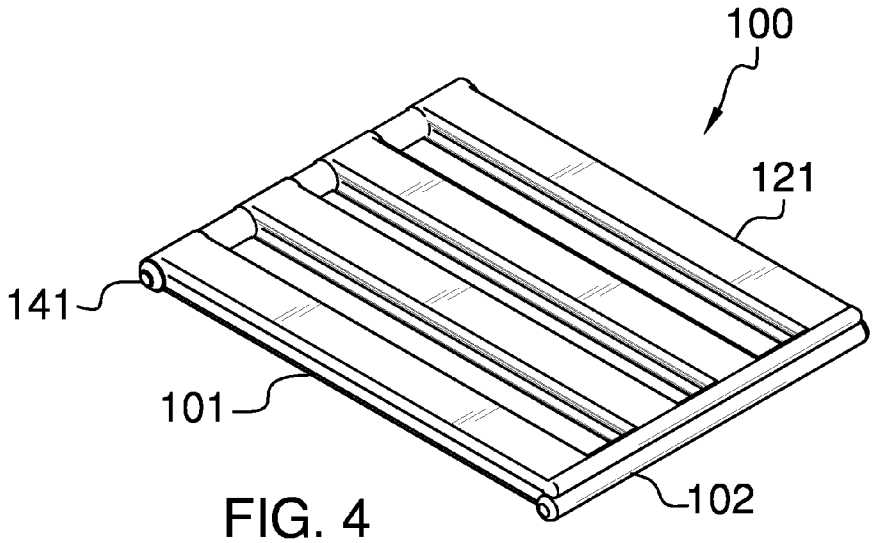
FIG. 4 is a perspective view of an embodiment of the disclosure in a closed position.
Figure 5:
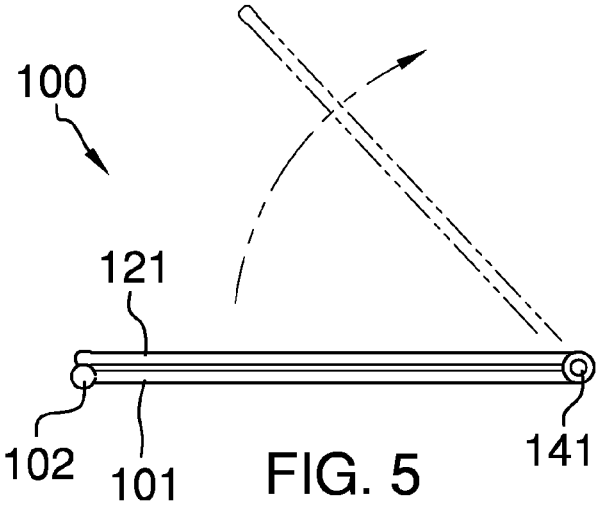
FIG. 5 is a side detailed view of an embodiment of the disclosure, and depicting the embodiment folding from a closed position to an in-use position.
Figure 6:
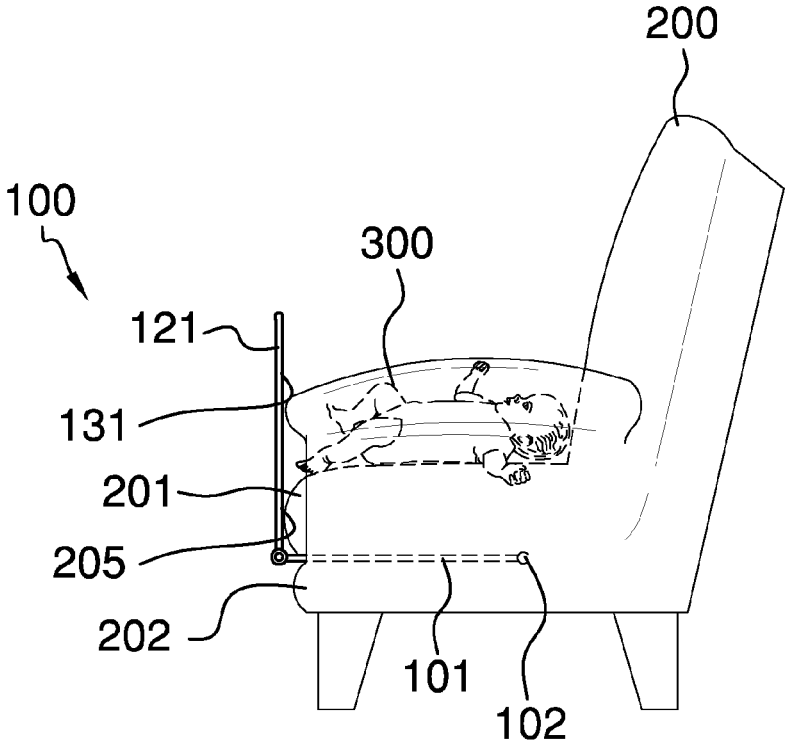
FIG. 6 is a side detailed view of an embodiment of the disclosure in use with a sofa or couch or chair.

As best illustrated in FIGS. 1 through 6, the infant rails for a couch 100 (hereinafter invention) generally comprises a base member 101 and a vertical member 121. The base member 101 is attached to the vertical member 121 via a hinge 141.

The base member 101 is further defined as a generally square or rectangularly-shaped object of a thin profile. The base member 101 is further defined with a first base member edge 102 and a second base member edge 103. The base member 101 is constructed of a plurality of base slats 104 that are generally parallel with one another. The base slats 104 may be equally spaced apart from one another via a base slat distance 105. The base member 101 is further defined with a base member length 106 and a base member width 107. The base member length 106 and the base member width 107 has a dimension that range from not less than 6 inches to not more than 36 inches.

The vertical member 121 is further defined as a generally square or rectangularly-shaped object of a thin profile. The vertical member 121 is further defined with a first vertical member edge 122 and a second vertical member edge 123. The vertical member 121 is constructed of a plurality of vertical slats 124 that are generally parallel with one another. The vertical slats 124 may be equally spaced apart from one another via a vertical slat distance 125. The vertical member 121 is further defined with a vertical member length 126 and a vertical member width 127. The vertical member length 126 and the vertical member width 127 has a dimension that range from not less than 6 inches to not more than 36 inches.

The vertical slats 124 are identical in size, shape, material with respect to the base slats 104. Moreover, the vertical slats 124 shall mirror that of the base slats 104, and vice verse.

The hinge 141 extends across both the second base member edge 103 of the base member 101 and the second vertical member edge 123 of the vertical member 121. The hinge 141 enables the vertical member 121 to rotate from a parallel orientation against the base member 101 to a perpendicular orientation with respect to the base member 101 (see FIGS. 3-5). Moreover, the vertical member 121 is further defined with an inner vertical surface 131, which touches an inner base surface 111 of the base member 101 when the invention 100 is folded flat, and not in use (see FIG. 4).

The first base member edge 102 of the base member 101 is further defined as an elongated cylinder that includes a cylinder diameter 113, which is greater than a base member thickness 114. The first base member edge 102 has the cylinder diameter 113 greater than the base member thickness 114 in order to aid in securing the invention 100 in place with a sofa 200. As a side note the term sofa 200 is being used to describe cushioned chairs, couches, chaise lounges, and other living room furniture where the invention 100 may be used.

In use, the base member 101 is configured to be placed in between a seat cushion 201 and a seat base 202 of the sofa 200. In other words, the base member 101 is sandwiched between the seat cushion 201 and the seat base 202 thereby securing the invention 100 in place with respect to the sofa 200. Moreover, the first base member edge 102 having the cylinder diameter 113 greater than the base member thickness 114 shall further secure the base member 101 between the seat cushion 201 and the seat base 202. It shall be noted that an object 300 positioned atop of the seat cushion 201 shall secure the base member 101 in between the seat cushion 201 and the seat base 202. It shall be noted that the inner vertical surface 131 of the vertical member 121 is configured to be abutted against an outer seat cushion surface 205 thereby forming a barrier to prevent said object 300 from falling or rolling off of the sofa 200.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An infant rail system configured for use with a sofa comprising:

a base member attached to a vertical member via a hinge;

wherein the base member is configured to be placed in between a seat cushion and a seat base of said sofa thereby securing the base member in place;

wherein the vertical member is configured to be placed against the seat cushion thereby forming a barrier to prevent an object from falling off of said sofa;

wherein the base member is further defined as a generally square or rectangularly-shaped object;

wherein the base member is further defined with a first base member edge and a second base member edge;

wherein the base member is constructed of a plurality of base slats that are generally parallel with one another, and extend between the first base member edge and the second base member edge;

wherein the vertical member is further defined as a generally square or rectangularly-shaped object; wherein the vertical member is further defined with a first vertical member edge and a second vertical member edge;

wherein the vertical member is constructed of a plurality of vertical slats that are generally parallel with one another, and extend between the first vertical member edge and the second vertical member edge;

wherein the base slats are equally spaced apart from one another via a base slat distance;

wherein the base member is further defined with a base member length and a base member width; wherein the base member length and the base member width each have a dimension that ranges from not less than 6 inches to not more than 36 inches;

wherein the vertical slats are equally spaced apart from one another via a vertical slat distance;

wherein the vertical member is further defined with a vertical member length and a vertical member width;

wherein the vertical member length and the vertical member width each have a dimension that ranges from not less than 6 inches to not more than 36 inches;

wherein the hinge extends across both the second base member edge of the base member and the second vertical member edge of the vertical member; wherein the hinge enables the vertical member to rotate from a parallel orientation against the base member to a perpendicular orientation with respect to the base member; wherein the vertical member is further defined with an inner vertical surface, which touches an inner base surface of the base member when folded flat, and not in use;

wherein the first base member edge of the base member is further defined as an elongated cylinder that includes a cylinder diameter, which is greater than a base member thickness.

* * * * *